US008151540B2

(12) United States Patent
Paz

(10) Patent No.: US 8,151,540 B2
(45) Date of Patent: Apr. 10, 2012

(54) WINDOW FILM ANCHORING DEVICE

(75) Inventor: Erez Paz, Moshav Emunim (IL)

(73) Assignee: Al-Sorag Ltd., Moshav Emunim (IL)

( * ) Notice: Subject to any disclaimer, the term of this patent is extended or adjusted under 35 U.S.C. 154(b) by 1344 days.

(21) Appl. No.: 11/523,220

(22) Filed: Sep. 18, 2006

(65) Prior Publication Data

US 2007/0209302 A1 Sep. 13, 2007

(30) Foreign Application Priority Data

Mar. 13, 2006 (IL) ..... 174290

(51) Int. Cl.
*E04B 1/00* (2006.01)

(52) U.S. Cl. ..... 52/745.15; 52/202; 52/204.53; 52/717.01; 52/717.03

(58) Field of Classification Search ..... 52/202, 52/203, 204.53, 204.5, 204.55, 214, 717.01–717.03, 52/741.3, 745.15, 745.16; 160/391, 399, 160/402

See application file for complete search history.

(56) References Cited

U.S. PATENT DOCUMENTS 4,586,301 A * 5/1986 Hickman ..... 52/96
5,214,892 A * 6/1993 Livingston et al. ..... 52/222
5,426,897 A * 6/1995 Gazaway ..... 52/204.53
5,553,422 A * 9/1996 Gazaway ..... 52/204.53
5,992,107 A * 11/1999 Poirier ..... 52/203
6,082,062 A 7/2000 Alflen
6,367,210 B1 * 4/2002 Trundle ..... 52/204.5

FOREIGN PATENT DOCUMENTS

GB 2327700 6/1999
WO WO 02/088504 11/2002

* cited by examiner

*Primary Examiner* — William Gilbert

(74) *Attorney, Agent, or Firm* — Roach Brown McCarthy & Gruber, P.C.; Kevin D. McCarthy

(57) ABSTRACT

A window film anchoring device is disclosed which comprises a first engagement member and a second engagement member between which a free film portion of a film affixed to a window pane is inserted. The first and second engagement members are attached to a corresponding window frame portion, and film engaging surfaces of the first engagement member are in interlocking and lateral motion preventing relation with complementary film engaging surfaces of the second engagement member so as to maintain a constant pressing force on the free film portion. The anchoring device is adapted to be a retrofit kit, and is able to be easily attached to an existing window frame, in order to increase the impact or impulse resistance of the window pane. The anchoring device may also be factory assembled to a newly produced frame.

29 Claims, 8 Drawing Sheets

WINDOW FILM ANCHORING DEVICE

FIELD OF THE INVENTION

The present invention relates to the field of window structures. More particularly, the invention relates to an anchoring device for window film, which is adapted to prevent the separation of a window pane from its frame.

BACKGROUND OF THE INVENTION

It is well known to employ window film consisting of a thin polymeric film, particularly a polyester film, which is applied to the inside surface of a window pane, to increase the impact resistance thereof. The window film also holds broken glass fragments together when a glass sheet is broken by an impact, such as an accidentally caused impact, e.g. initiated by physical activity, a deliberately caused impact, e.g. as a result of a break-in attempt or a bomb explosion, or a natural phenomenon, e.g. a hurricane or an earthquake.

The window film is generally applied to the visible portion of the pane, and therefore the edge portions of the pane which are concealed by the window frame are not protected. When a window pane is impacted, a large force concentration is applied to the unprotected edge portions, causing the filmed pane portion to separate from the edge portions and fall inwardly into the room as a single entity. An intruder may also gain entry to the room by using a suitable implement to break the glass near the unprotected edge portions, separating the filmed pane portion from the unprotected edge portions, and squeezing between the filmed pane portion and the unprotected edge portions so as to enter the room.

To prevent injury or damage resulting from a pane that inwardly falls into the room, and to further prevent the separation of a window pane from its frame, the prior art employs various means to secure the window film to the window frame.

U.S. Pat. No. 5,992,107 discloses a tensile loading transfer strip having two load bearing flanges. A double sided foam adhesive strip is mounted on each flange such that one strip is mounted to an edge of window film adhered to a glass window pane and the second strip is mounted to an edge of a window frame.

U.S. Pat. No. 6,082,062 discloses a security attachment system includes two-sided tape that overlaps an edge portion of a film covering a glass pane and a side portion of the adjacent window frame. A hollow flange track having a right-angled cross-sectional shape is positioned over the tape, for each of the four edges whereat the frames meet the glass panes. Each flange is fastened to the window frame.

WO 02/088504 discloses an anchoring profile comprising two outer strips of substantially rigid plastic material for attachment by adhesive to the window film and the window frame, respectively, and a flexible interconnecting strip between the outer strips.

The element of each of the aforementioned prior art securing means that is adhered to both the film and the window frame is exposed to inclement weather conditions and to sunlight, and therefore will detach from the window film or from the window frame over the course of time, requiring labor intensive operations relating to the replacement of the securing means. Furthermore, the adhesive force by which the securing means is attached to the window frame is of limited strength, and the securing means is liable to fail when subjected to a relatively low impact of approximately 5-7 psi. Means of securing a window film of greater reliability and of greater strength is therefore needed.

GB 2327700 discloses a clamping profile comprising a first elongate side portion having a ribbed film contacting surface which is attached to the surrounding frame to clamp the overlapping film, a rounded edge to prevent the film from tearing under load, and a second elongate side portion having a sealing gasket for cushioning impact movement of the pane and film. In this publication, the clamping profile also reduces the amount of light that is transmitted through the window pane into the room. Furthermore, the window film is liable to be dislodged from underneath the film contacting surface when the window pane is subjected to a relatively low impulse of approximately 5-7 psi, which causes the pane to bend and to be separated from its frame.

It is an object of the present invention to provide a window film anchoring device which is adapted to prevent the separation of a pane from the frame in which it is mounted.

It is an additional object of the present invention to provide a window film anchoring device that can withstand an impact of a greater magnitude than that of the prior art.

It is an additional object of the present invention to provide a window film anchoring device that is not exposed to inclement weather conditions or to sunlight.

It is yet an additional object of the present invention to provide a window film anchoring device that can be easily attached to an existing frame.

Other objects and advantages of the invention will become apparent as the description proceeds.

SUMMARY OF THE INVENTION

The present invention is a novel window film anchoring device which comprises interlocking upper and lower engagement members. A thin polymeric film, e.g. a polyester film, having a thickness of at least 200 microns and being transparent, translucent, or being treated with ultraviolet, visible light, infrared, or radio wave filtering properties (hereinafter a "window film") is applied to the inner surface of a window pane, to increase the impact resistance thereof. The "inner surface" is defined herein as the surface facing the room being illuminated by the light propagating through the pane, and the "outer surface" is the window pane surface facing the exterior of the room. The length of the window film is greater than that of the window pane such that a portion of the window film extends from the corresponding pane edge (hereinafter the "free film portion"). Lateral motion of the free film portion is prevented when the latter is positioned between the upper and lower engagement members. "Lateral motion" is defined herein as movement of the free film portion in a direction that would result in its being dislodged from the anchoring device.

Prior art window film anchoring devices resist lateral motion of the free film portion by means of an element adhered to the window frame and to the window film, or by means of an element overlying the free film portion which is attached to the window frame and thereby applies a force normal to the lateral direction. However, when the window pane is subjected to a sufficiently high impact that causes the pane to bend and to pull the window film in the lateral direction, the force applied by said element is unable to resist lateral motion and the window pane is separated from the frame in which it is mounted. The anchoring device of the present invention, in contrast, constantly presses on the free film portion from above and below, and the interlocking feature of the upper and lower engagement members further prevents lateral motion of the free film portion when a film engaging surface of one of the engagement members pressingly contacts an adjacent film engaging surface of the other engagement member, to provide superior film gripping performance. Tests conducted by the applicant have revealed that a pane secured by the anchoring device of the present invention has an impact resistance of up to 20 psi when an anchoring device is applied to two opposite sides of the window, and much greater when applied to four sides of the window. Regarding impulse resistance, tests have revealed that a pane can withstand an impulse of up to 100 psi-msec when an anchoring device is applied to two opposite sides of the window, and much greater when applied to four sides of the window.

The engagement members are referred to herein as an "upper engagement member" and a "lower engagement member" with respect to an anchoring device affixed to a lower horizontal frame portion, but it will be appreciated that the upper engagement member may be disposed below than, or to the side of, the lower engagement member when the anchoring device is affixed to a differently disposed frame portion. The terms "upper engagement member" and "lower engagement member" are interchangeable with "first engagement member" and "second engagement member", respectively.

The anchoring device is adapted to be a retrofit kit, and is able to be easily attached to an existing window frame, in order to increase the impact or impulse resistance of the window pane. As referred to herein, a "window frame" or "frame" means the frame of any suitable window pane, including house windows, e.g. sash windows, casement windows, bay windows, picture windows, and skylights, or commercial windows, e.g. curtain walls, store fronts, and showcases. However, the anchoring device may also be factory assembled to a newly produced frame.

Accordingly, the anchoring device of the present invention comprises a first engagement member and a second engagement member between which a free film portion of a film affixed to a window pane is insertable, said first and second engagement members being attachable to a corresponding window frame portion, film engaging surfaces of said first engagement member capable of being in interlocking and lateral motion preventing relation with complementary film engaging surfaces of said second engagement member so as to maintain a constant pressing force on said free film portion.

The film engaging surfaces of the first and second engagement members are preferably a plurality of alternating protruding and recessed elements.

In one aspect, each pair of adjacent film engaging surfaces are in contact to define a pointed apex such that corresponding apexes of interlocked first and second engagement members are substantially collinear.

In one aspect, the film engaging surfaces of the first and second engagement members are curvilinear.

In one aspect, the anchoring device further comprises a cover, e.g. having a horizontal portion and a portion oblique to said horizontal portion, which is coupleable with the first engagement member.

The present invention is also directed to a window frame assembly which comprises the anchoring device.

In one aspect, the anchoring device is attached to a window frame bottom member and a cover side wall coplanar with, and is substantially in contact with, a corresponding side wall of said bottom member.

In one aspect, the window frame assembly further comprises a second anchoring device which is attached to a window frame top member, said second anchoring device having a cover side wall which is coplanar with, and is substantially in contact with, a corresponding side wall of said top member.

Before the anchoring device is attached to the window frame, the inner surface of the window pane having a first visible portion dimension and a second visible portion dimension and of the frame is thoroughly cleaned. If the anchoring device is attached to an existing window frame, the window film, if present, is removed, and then the window pane and frame are cleaned. A gasket is coupled with one of the first and second engagement members, depending on the configuration of the frame.

A second engagement member having a selected length substantially equal to said first visible portion dimension or said second visible portion dimension is attached to a corresponding first frame portion. A window film having a first dimension substantially equal to said selected length of said second engagement member and a second dimension significantly longer than said first visible portion dimension or said second visible portion dimension not being equal to said selected length of said second engagement member is attached to said window pane visible portion such that at least one free film portion extends from said window pane visible portion. After positioning said free film portion to be in close proximity to said second engagement member, a terminal portion of a first free film portion having said first window film dimension is applied to film engaging surfaces of said second engagement member such that a portion of said free film portion can contact said-first frame portion or said second engagement member. A first engagement member having said selected length is placed in pressing contact with said first free film portion such that film engaging surfaces of said first engagement member are in interlocking relation with corresponding film engaging surfaces of said second engagement member, and then said first engagement member is attached to said first frame portion. After the first free film portion is trimmed, an anchoring device cover is releasably coupled, e.g. by a snap fit, with said first engagement member.

For optimal impact or impulse resistance, a second anchoring device is attached to a second frame portion opposite said first frame portion. If so desired, a third anchoring device may be attached to a third frame portion perpendicular to said first frame portion, and a fourth anchoring device may be attached to a fourth frame portion opposite said third frame portion As referred to herein, the term "opposite" means separated by a distance substantially equal to said first or second window pane visible portion.

When a second anchoring device is employed, a terminal portion of a second free film portion having said first window film dimension is applied to film engaging surfaces of a second engagement member of said second anchoring device. The first engagement member of said second anchoring device is placed in pressing contact with said second free film portion applied to said second engagement member of said second anchoring device, and then said first engagement member of said second anchoring device is attached to said second frame portion. An anchoring device cover is then releasably coupled with said first engagement member of said second anchoring device.

When an anchoring device is used to retrofit an existing frame, a gasket retainer and the gasket retained thereby are removed and replaced by the gasket which is coupled with one of the first and second engagement members.

DETAILED DESCRIPTION OF PREFERRED EMBODIMENTS

Figure 1:
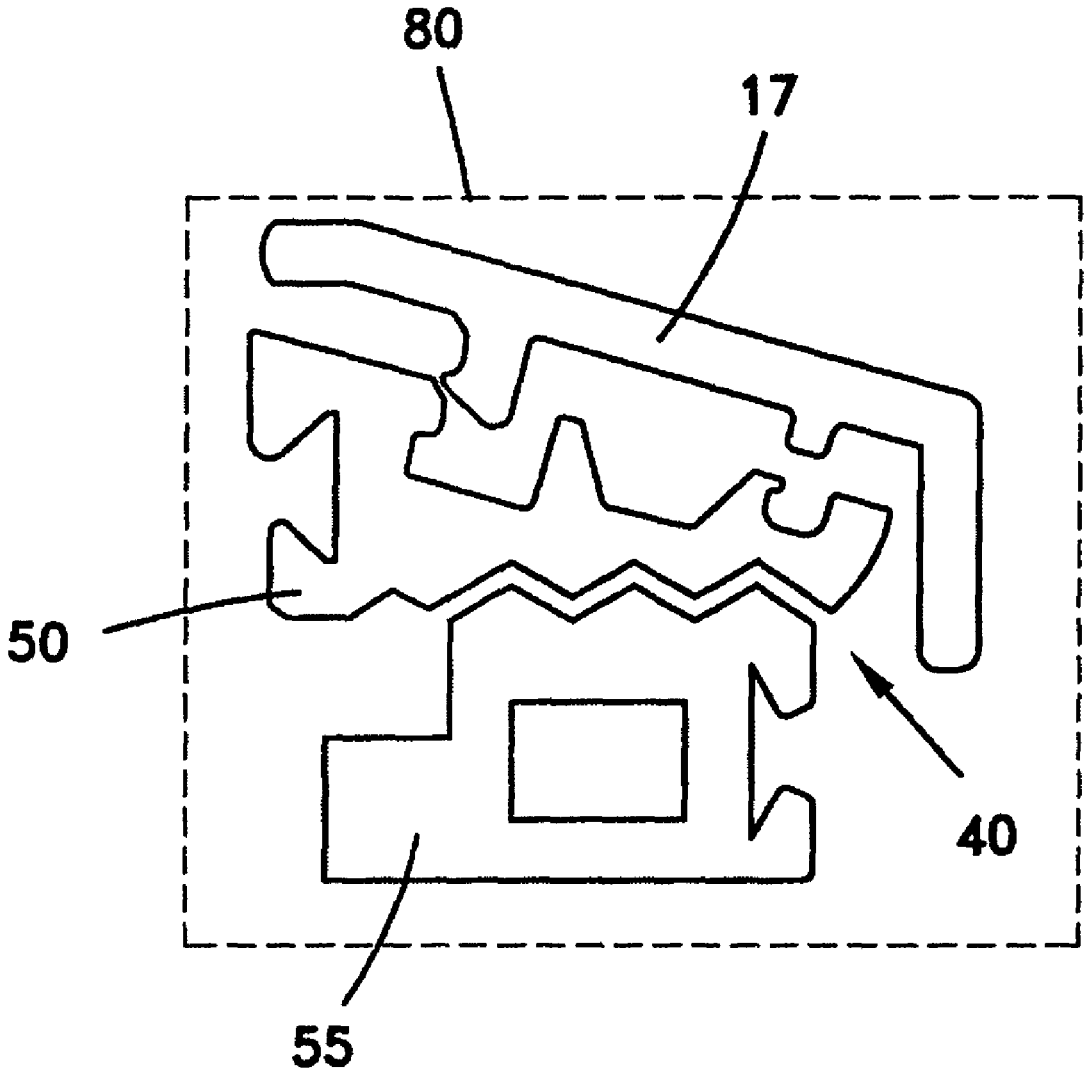
FIG. 1 is a schematic illustration of a kit in which an anchoring device according to one embodiment of the invention is sold.

FIG. 1 illustrates a disassembled anchoring device according to one embodiment of the present invention, and is generally indicated by numeral 40. Anchoring device 40 may be sold or distributed as a kit 80 as shown in order to retrofit an existing window frame, for increasing the impact or impulse resistance thereof, or may be mounted on an original factory produced window frame. As shown, anchoring device 40 comprises upper engagement member 50, lower engagement member 55, and cover 17.

When anchoring device 40 is in kit form, upper engagement member 50, lower engagement member 55, and cover 17 are separate components. An assembly worker may easily remove one or more kits 80 from a storage facility, attach lower engagement member 55 to a selected window frame portion, apply window film to the inner surface of a window pane, position the free film portion which is not adhered to the pane above lower engagement member 55, interlock upper engagement member 50 with lower engagement member 55 such that the free film portion is being constantly pressed by the two engagement members, and attach upper engagement member to the selected frame portion. The applicant has surprisingly discovered that an anchoring device comprising upper and lower engagement members dramatically increases the impact or impulse resistance of the window pane with respect to one of the prior art.

Figure 2:
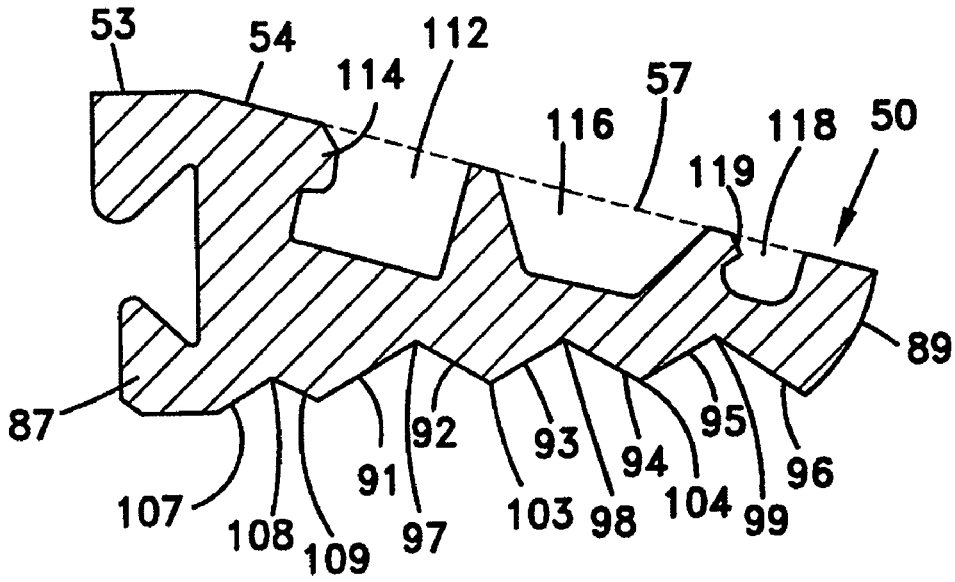
FIG. 2 is a vertical cross-sectional view of an upper engagement member of the anchoring device of FIG. 1.
Figure 3:
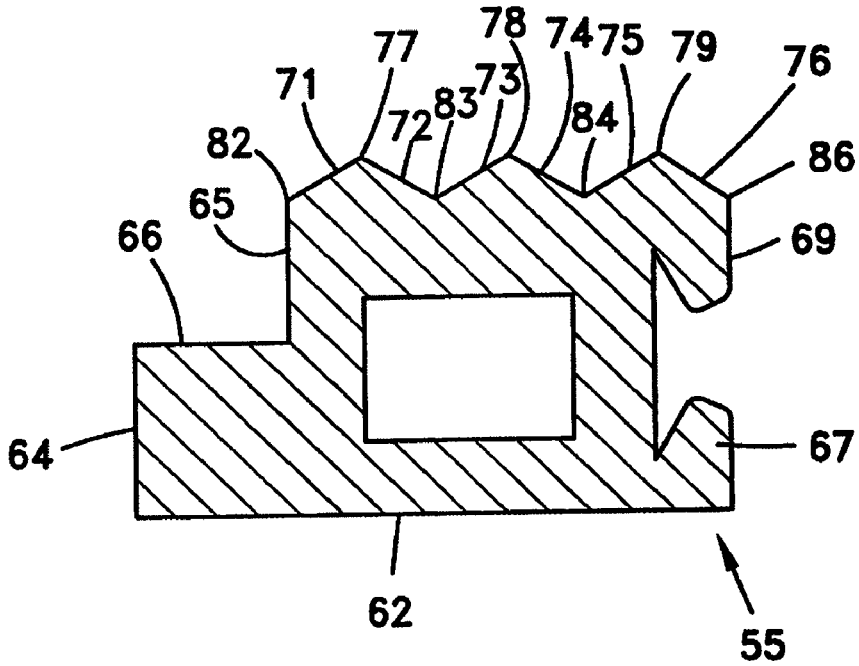
FIG. 3 is a vertical cross-sectional view of a lower engagement member of the anchoring device of FIG. 1.

FIGS. 2 and 3 illustrate upper engagement member 50 and lower engagement member 55, respectively in greater detail.

In the illustrated orientation, lower engagement member 55 has a planar contact surface 62 which is supported by a corresponding frame portion, outer side wall 64 substantially perpendicular to contact surface 62, inner side wall 65 substantially parallel to, and transversally spaced from, outer side wall 64, connecting surface 66 substantially parallel to contact surface 62 and extending from side wall 64 to side wall 65, gasket retaining C-shaped element 67 the recess of which faces inwardly, and film engaging surfaces extending from inner side wall 65 to upper vertical surface 69 of C-shaped element 67. The inner surface is defined herein as the surface facing the room being illuminated by the light propagating through the window pane.

Upper engagement member 50 has a C-shaped element 87 at the outer end thereof for retaining a gasket and film engaging surfaces at the bottom of upper engagement member 50. Inner end 89 of upper engagement member 50 is arcuate. Upper engagement member 50 has an upper surface that consists of a horizontal portion 53 and coplanar portions 54 that define line 57 which is oblique with respect to horizontal portion 53. The oblique upper surface portion of upper engagement member 50 is formed with three cavities. Outer cavity 112 is substantially U-shaped, and lip 114 inwardly protrudes into cavity 112. Central cavity 116 is trapezoidal with respect to line 57, in order to accommodate screws 49 (FIG. 8), for connecting anchoring device 40 to the corresponding frame portion. Inner cavity 118, into which lip 119 protrudes, is substantially U-shaped and is considerably smaller than outer cavity 112.

In this embodiment, the film engaging surfaces of upper and lower engagement members 50 and 55 have a similarly shaped, constantly spaced, zigzag configuration with interlockable pointed edges. Film engaging surfaces of upper engagement member 50 may therefore be seated on corresponding film engaging surfaces of lower engagement member 55 in such a way that relative lateral displacement of one of the engagement members, i.e. in a direction that would allow a free film portion to be dislodged from the anchoring device, is prevented.

As shown, the film engaging surfaces of lower engagement member 55 are a plurality of planar surfaces 71-76 of a substantially uniform length which are oblique to inner side wall 65 thereof and upper vertical surface 69 of C-shaped element 67. Each two adjacent film engaging surfaces are in contact so as to define three collinear apexes 77-79 and two collinear junctions 83 and 84, such that each junction is lower than, and interposed between, two adjacent apexes. Surface 71 contacts inner side wall 65 to form junction 82, and surface 76 contacts upper vertical surface 69 of C-shaped element 67 to form junction 86.

The film engaging surfaces of upper engagement member 50 are similarly shaped to those of lower engagement member 55. That is, the film engaging surfaces of upper engagement member 50 have a plurality of planar surfaces 91-96 of a substantially uniform length which are configured such that each two adjacent film engaging surfaces are in contact so as to define three collinear apexes 97-99 and two collinear junctions 103 and 104, such that each junction is lower than, and interposed between, two adjacent apexes. As upper engagement member 50 is placed in pressing relation to lower engagement member 55, apexes 97-99 of upper engagement member 50 are positioned such that they are in substantially vertical alignment with apexes 77-79 of lower engagement member 55, respectively, and that junctions 103-104 of upper engagement member 50 are in substantially vertical alignment with junctions 83-84 of lower engagement member 55, respectively. When one of the engagement members is slightly laterally displaced, a film engaging surface of one engagement member abuts a corresponding film engaging surface of the other engagement member, thereby retarding further lateral motion. Consequently the free film portion is continuously pressed by upper engagement member 50 and lower engagement member 55.

Upper engagement member 50 also has another apex 108 defined by two planar surfaces 107 and 109 formed outwardly from surface 91. Apex 108 is of use when the volume between two frame portions in which the anchoring device is mounted is limited such that C-shaped element 87 would bear on the window pane without rearrangement. The provision of the additional apex 108 allows upper engagement member 50 to be inwardly shifted. As upper engagement member 50 is inwardly shifted away from the window pane and placed in pressing relation with lower engagement member 55, apexes 108, 97, and 98 of upper engagement member 50 are positioned such that they are in substantially vertical alignment with apexes 77-79 of lower engagement member 55, respectively.

It will be appreciated that anchoring device 40 is equally effective when the apexes and junctions of each of lower engagement member 55 and upper engagement member 50 are not collinear insofar as the apexes of upper engagement member 50 are positioned such that they are in substantially vertical alignment with corresponding apexes of lower engagement member 55, and that the junctions of upper engagement member 50 are in substantially vertical alignment with corresponding junctions of lower engagement member 55, to allow lower engagement member 55 and upper engagement member 50 to be in a secured, interlocking relation.

Figure 4:
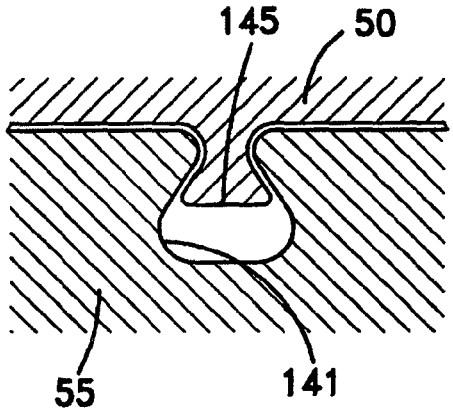
FIG. 4 is a vertical cross-sectional view of film engaging surfaces according to another embodiment of the invention.

Similarly, the film engaging surfaces may be configured without apexes and junctions insofar as upper engagement member 50 and lower engagement member 55 are able to be interlocked such that relative lateral motion is prevented. FIG. 4 illustrates curvilinear film engagement surfaces. As shown, lower engagement member 55 has a female, recessed film engagement surface 141 and upper engagement member 50 has a male, protruding element 145. Film engagement surfaces 141 and 145 are complementary such that upper engagement member 50 is interlocked with lower engagement member 55 only when male film engagement surface 145 is inserted into the recess of female engagement surface 141 and then transversally displaced, i.e. along a plane parallel to the window pane surface.

The anchoring device may be mounting in any suitable window frame, including a frame of a house window, e.g. a sash window, casement window, bay window, picture window, and skylight, or a frame for a commercial application, e.g. a curtain wall, store front, and showcase.

FIGS. 5-9 illustrate an anchoring device of the present invention which is mounted in an exemplary house window frame, the Kalil 2000, manufactured by Kalil, Israel.

Figure 5:
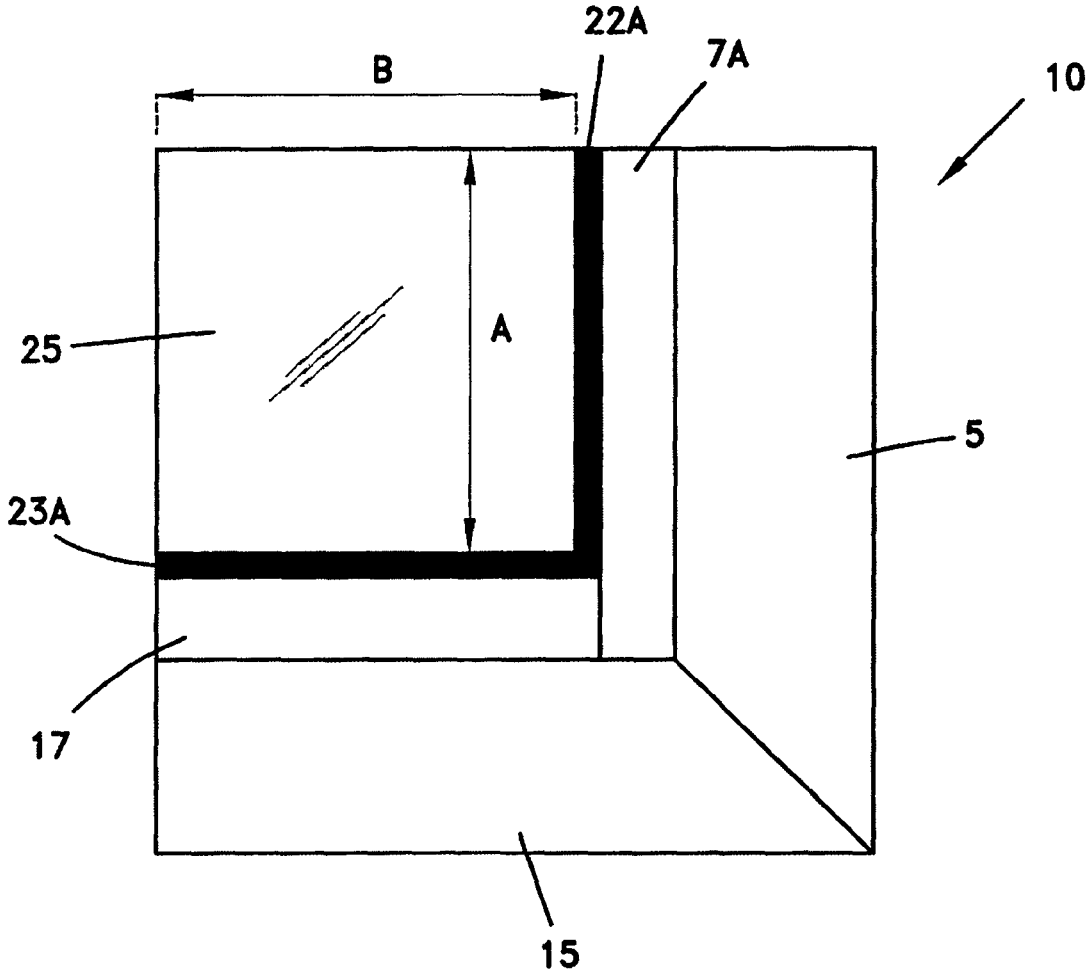
FIG. 5 is a front view of a section of a window frame assembly in which an anchoring device of the invention is mounted.

FIG. 5 illustrates a front view of a section of the window frame assembly of the present invention, which is generally indicated by numeral 10. The window frame assembly is preferably made of aluminum for its high corrosion resistance, high strength, good formability, and low price, but may be made, or any component thereof, from any other suitable material. Window frame section 10 is shown to have side member 5, vertical gasket retainer 7*a* that is coupled with side member 5, bottom member 15 attached to side member 5, and cover 17 of the anchoring device. The anchoring device is attached to bottom member 15. Vertical gasket 22A and horizontal gasket 23A, which are coupled to window frame assembly 10, are used to cushion window pane 25, e.g. made of glass, and to maintain the same in a substantially stationary, vertical disposition. The illustrated section of window pane 25, which is supported on central portion 45 of bottom member 15 (FIGS. 6 and 8) has a first visible portion dimension A and a second visible portion dimension B perpendicular to visible portion A.

A thin transparent polymeric film 31, e.g. a polyester film, is applied to the inner surface of window pane 25, to increase the impact resistance thereof. Film 31 is considerably longer than visible portion A of window pane 25, and is applied to pane 25 such that the upper edge of the film is applied to approximately the upper edge of window pane 25 while a free film portion 31A thereof extends below the bottom edge of the window pane. Even as the free film portion 31A that extends from pane 25 is engaged by the anchoring device, the latter is not visible and the window frame assembly 10 therefore provides an aesthetic appearance and transmits a maximum amount of light through pane 25.

Figure 6:
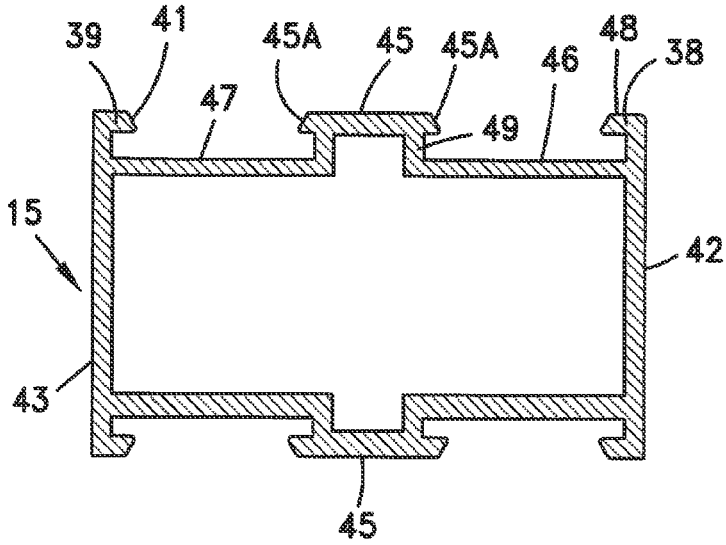
FIG. 6 is a vertical cross-sectional view of a bottom member of the frame assembly of FIG. 5.

FIG. 6 illustrates a vertical cross-sectional view of bottom member 15. Bottom member 15 and side member 5 are identical components, and therefore the following description of bottom member 15 is similarly applicable to side member 5. Bottom member 15 is rectilinear, and is defined by inner side wall 42, outer side wall 43, and by upper and lower central surfaces 45 substantially perpendicular to side walls 42 and 43. The inner and outer ends of central surface terminate with oblique surface 45A. Bottom member 15 also has inner abutment surface 46 and outer abutment surface 47 coplanar with inner abutment surface 46, which are separated from central surface 45 by spacers 49. Symmetrical legs 38 and 39 terminating with oblique surface 41 extend from the top of side walls 42 and 43, and have a surface 48 that is coplanar with central surface 45. The bottom of bottom member 15 is symmetrical with the top thereof, and is also provided with legs 38 and 39 and with surfaces 46 and 47.

Figure 7:
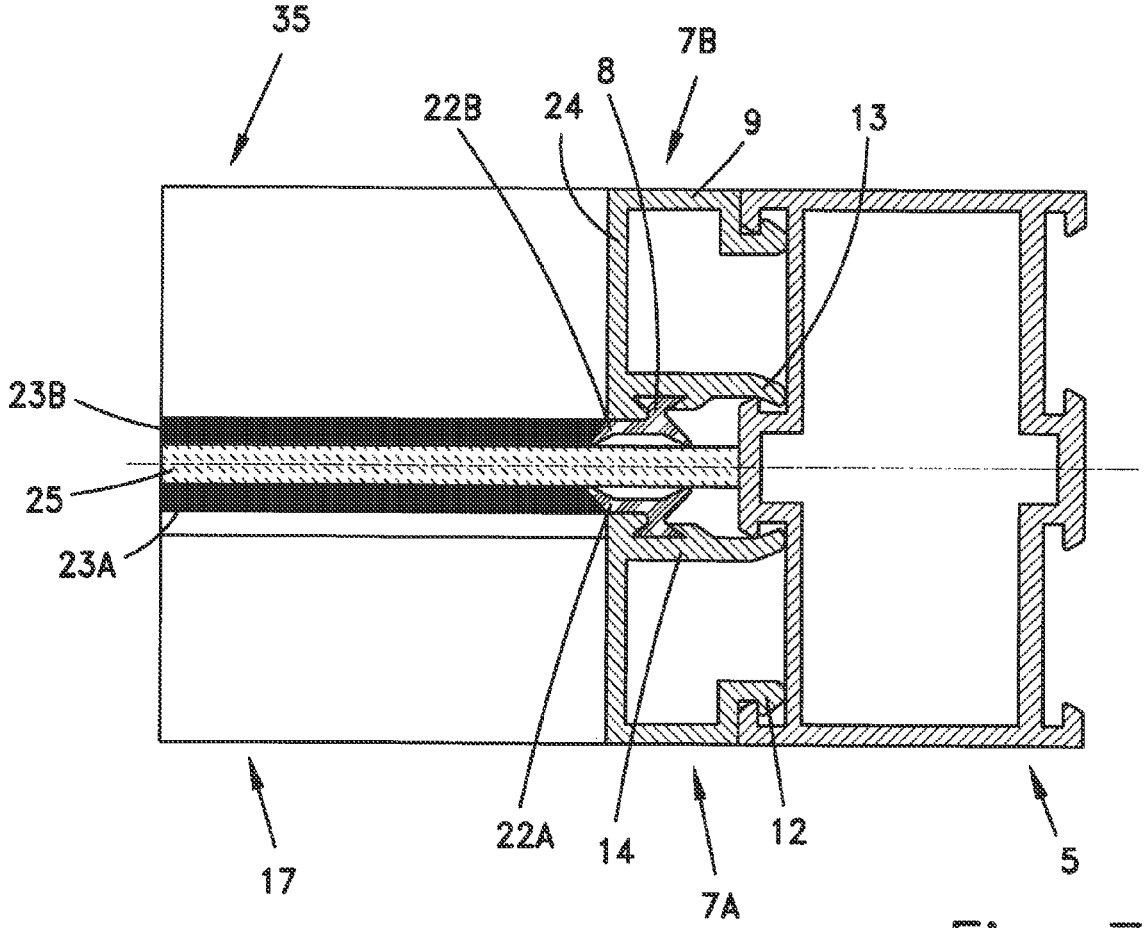
FIG. 7 is a horizontal cross-sectional view of the window frame assembly of FIG. 5.

As shown in the horizontal cross-sectional view of window section 10 illustrated in FIG. 7, window pane 25 is cushioned by vertical gaskets 22A and 22B positioned on opposite faces of the window pane by inner vertical gasket retainer 7A and outer vertical gasket retainer 7B, respectively Inner and outer vertical gasket retainers 7A and 7B are identical components which are symmetrically disposed. A triangular element 8 projecting from each vertical gasket is received in a complementarily shaped recess of the corresponding vertical gasket retainer. Each vertical gasket retainer has a side wall 9 substantially coplanar with the corresponding side wall of side member 5 and a second wall 14 formed with the recess with which triangular element of the vertical gasket is coupled. Lateral wall 24, which connects walls 9 and 14 and is substantially perpendicular to pane 25, is sized to maintain the corresponding gasket in contact with window pane 25. Inner and outer vertical gasket retainers 7A and 7B are coupled to side member 5 by means of a C-shaped element 12 interlocked with a corresponding leg and of oblique element 13 in pressed frictional contact with the corresponding oblique surface 45A (FIG. 6) and abutment surface of side member 5.

Window pane 25 is further cushioned by inner horizontal gasket 23A and outer horizontal gasket 23B positioned on opposed faces of the window pane by C-shaped element 87 of upper engagement member 50 (FIG. 2) and by horizontal gasket retainer 35, respectively. Horizontal gasket retainer 35 is identical to a vertical gasket retainer, and therefore need not be described. Although only a limited section of the window frame is illustrated, it will be appreciated that a pair of gaskets is applied along the entire periphery of the visible portion of window pane 25.

Figure 9:
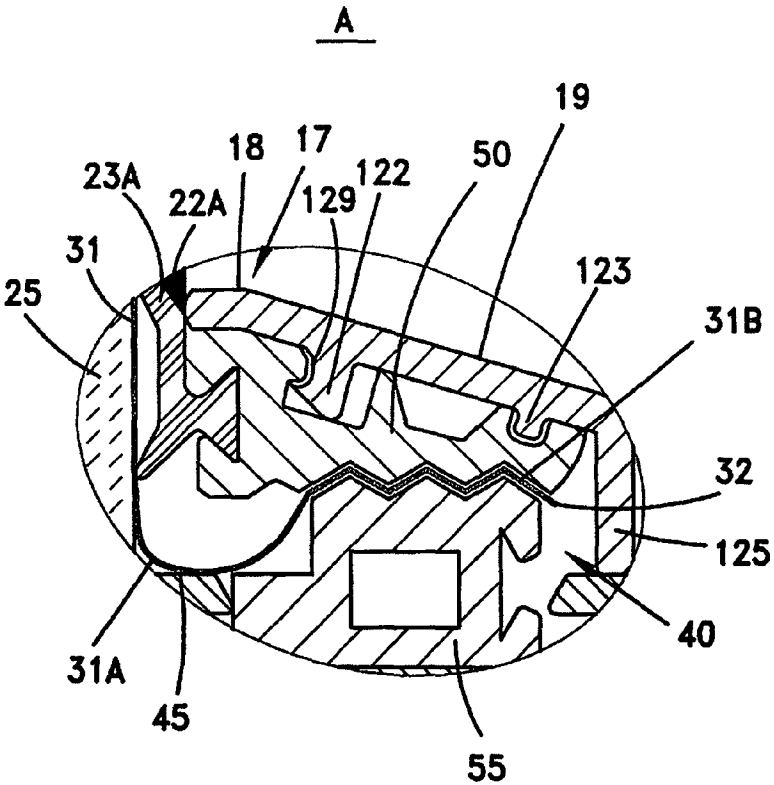
FIG. 9 is a magnified view of Detail A of FIG. 4.
Figure 8:
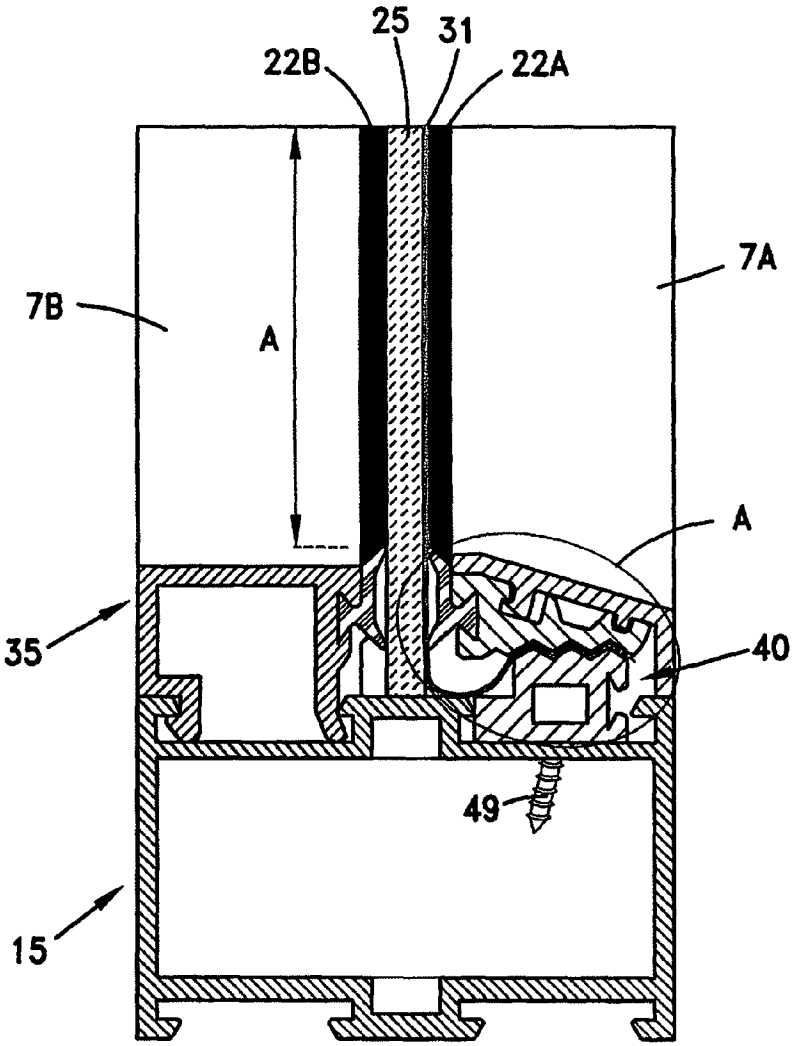
FIG. 8 is a vertical cross-sectional view of the window section of FIG. 5.

FIG. 8 illustrates a side cross-sectional view of the window frame section of FIG. 5 and FIG. 9 is a magnified view of Detail A. Window pane 25 is supported by planar central surface 45 of bottom member 15 (FIG. 6). Planar contact surface 62 of lower engagement member 55 (FIG. 3) is supported by inner abutment surface 46 of bottom member 15. Anchoring device 40 is attached to inner abutment surface 46 of bottom member 15 by metal fasteners, e.g. screws 49 or rivets, and therefore does not block the light impinging upon window pane 25. Horizontal gasket retainer 35 is coupled to bottom member 15 by means of C-shaped element 12 (FIG. 7) interlocked with leg 39 (FIG. 6) and by means of oblique element 13 in pressed frictional contact with oblique surface 45A and abutment surface 47 of bottom member 15. Window film 31 is shown as being affixed to, e.g. by adhesion, the inner face of pane 25. Free film portion 31A downwardly extending from film 31, which is affixed to pane 25, is introduced into anchoring device 40. Upper engagement member 50 has a C-shaped element 87 (FIG. 2) at the outer end thereof in which is retained the lower inner horizontal gasket 23A being in sealing relation with window film 31.

As shown further in FIG. 2 oblique coplanar portions 54 of upper engagement member 50 define a line 57 which is oblique with respect to horizontal portion 53. The oblique configuration of the upper surface of upper engagement member 50 advantageously minimizes the blockage of light impinging upon pane 25. By allowing a drill or any other suitable implement which is adapted to attach the engagement members to inner abutment surface 46 of bottom member 15 (FIG. 6) to be disposed in an oblique disposition rather than in a vertical disposition, the body of the implement is separated from pane 25 and therefore the risk of damage thereto is reduced.

Referring back to FIG. 9, anchoring device cover 17 is releasably coupleable with upper engagement member 50, e.g. by a snap fit. Cover 17 has an upper surface that consists of a horizontal portion 18 and oblique portion 19 that is substantially parallel to line 57 defining coplanar portions 54 of upper engagement member 50. Coupling elements 122 and 123 protrude from the underside of oblique portion 19. Cover 17 also has vertical wall 125 that is substantially coplanar with, and is substantially in contact with, inner wall 42 of bottom member 15 (FIG. 6), when cover 17 is coupled with anchoring device 40. Coupling element 122 has a recessed outer face 129 in the vicinity of the underside of oblique portion 19, which is engaged with lip 114 of upper engagement member 50 (FIG. 2) when cover 17 is coupled therewith. Recessed outer face 129 allows cover 17 to be coupled by a snap fit with upper engagement member 50 when held obliquely with respect to line 57 defining the upper surface of upper engagement member 50 (FIG. 2), yet is prevented from being lifted by lip 114 of upper engagement member 50. Coupling element 123 has a substantially U-shaped cross-section, which is coupleable by a snap fit with lip 119 protruding into inner cavity 118 of upper engagement member 50.

If so desired, upper engagement member 50 may be provided without a cover, whereby the upper surface thereof is a continuous surface 57 imparted with water resistant properties, which is preferably provided connected to a side wall (not shown) coplanar with side wall 42 of bottom member 15. When a cover is not employed, upper engagement member 50 and lower engagement member 55 are affixed to inner abutment surface 46 of bottom member 15 by any means well known to those skilled in the art.

When terminal portion 31B of film 31 is placed on the film engaging surfaces of lower engagement member 55, the film engaging surfaces of upper engagement member 50 are seated on corresponding film engaging surfaces of lower engagement member 55, and lower engagement member 55 is affixed to bottom member 15, e.g. by means of screws 49 that pierce through upper engagement member 50, terminal portion 31B, and lower engagement member 55, terminal film portion 31B is pressed by upper engagement member 50 and lower engagement member 55. The lateral displacement of terminal film portion 31B is therefore prevented due to the pressing action applied by stationary upper engagement member 50 onto stationary lower engagement member 55. Free film portion 31A is of a sufficient length such that it contacts central surface 45 of bottom member while terminal portion 31B is pressed by the film engaging surfaces of upper engagement member 50 and lower engagement member 55, and that end 32 of terminal film portion 31B only slightly protrudes from inner end 89 of upper engagement member 50.

Lateral movement of upper engagement member 50 with respect to lower engagement member 55 is therefore prevented, due to the contact of an upper engagement member film engaging surface with a corresponding underlying lower engagement member film engaging surface. When window pane 25 is impacted, such as a result of an accidentally caused impact, e.g. initiated by physical activity, a deliberately caused impact, e.g. as a result of a break-in attempt or a bomb explosion, or a natural phenomenon, e.g. a hurricane or an earthquake, the upper portions of pane 25 bend inwardly, i.e. towards anchoring device 40. Since terminal film portion 31B is immobilized as a result of the pressing action applied by the film engaging surfaces of lower engagement member 55 and upper engagement member 50, free film portion 31A is stretched as pane 25 bends. Free film portion 31A therefore absorbs the impact energy applied to pane 25 while anchoring device 40 prevents pane 25 from being separated from window frame 10.

It is desirable to attach a second anchoring device to a top member of the frame when window pane 25 is subjected to an impact or an impulse of a very high level which invariably causes the pane to shatter. The second anchoring device prevents window pane 25 from bending, and therefore glass fragments which are prevented from entering the enclosure are urged outwardly. If so desired, the two anchoring device may be attached to the two side members, respectively, of the frame, or alternatively, four anchoring devices may be employed, two to the side members, respectively, and two to the top and bottom members, respectively.

Figure 10:
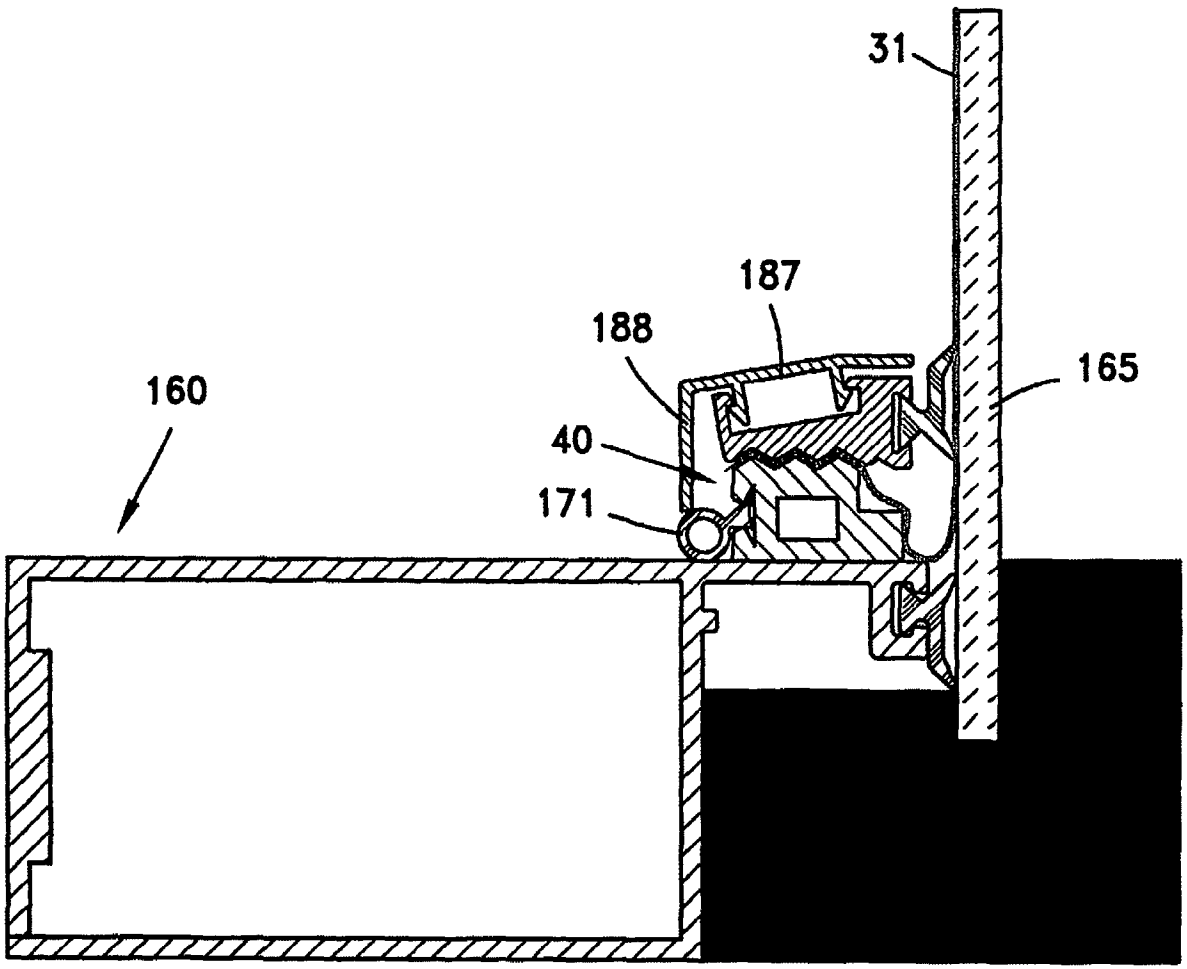
FIG. 10 is a vertical cross-sectional view of a curtain wall frame in which an anchoring device of the invention is mounted.

FIG. 10 illustrates anchoring device 40 being mounted in curtain wall frame 160, which is only partially illustrated. Window film 31 applied to glass curtain wall 165 is secured by anchoring device 40. C-shaped element 67 of lower engagement member 55 (FIG. 3) is shown to retain gasket 171. Side wall 188 of anchoring device cover 187 extends to gasket 171, and therefore dust, rain, or any unwanted foreign particles are prevented from infiltrating to anchoring device 40 or to curtain wall 165.

Figure 11:
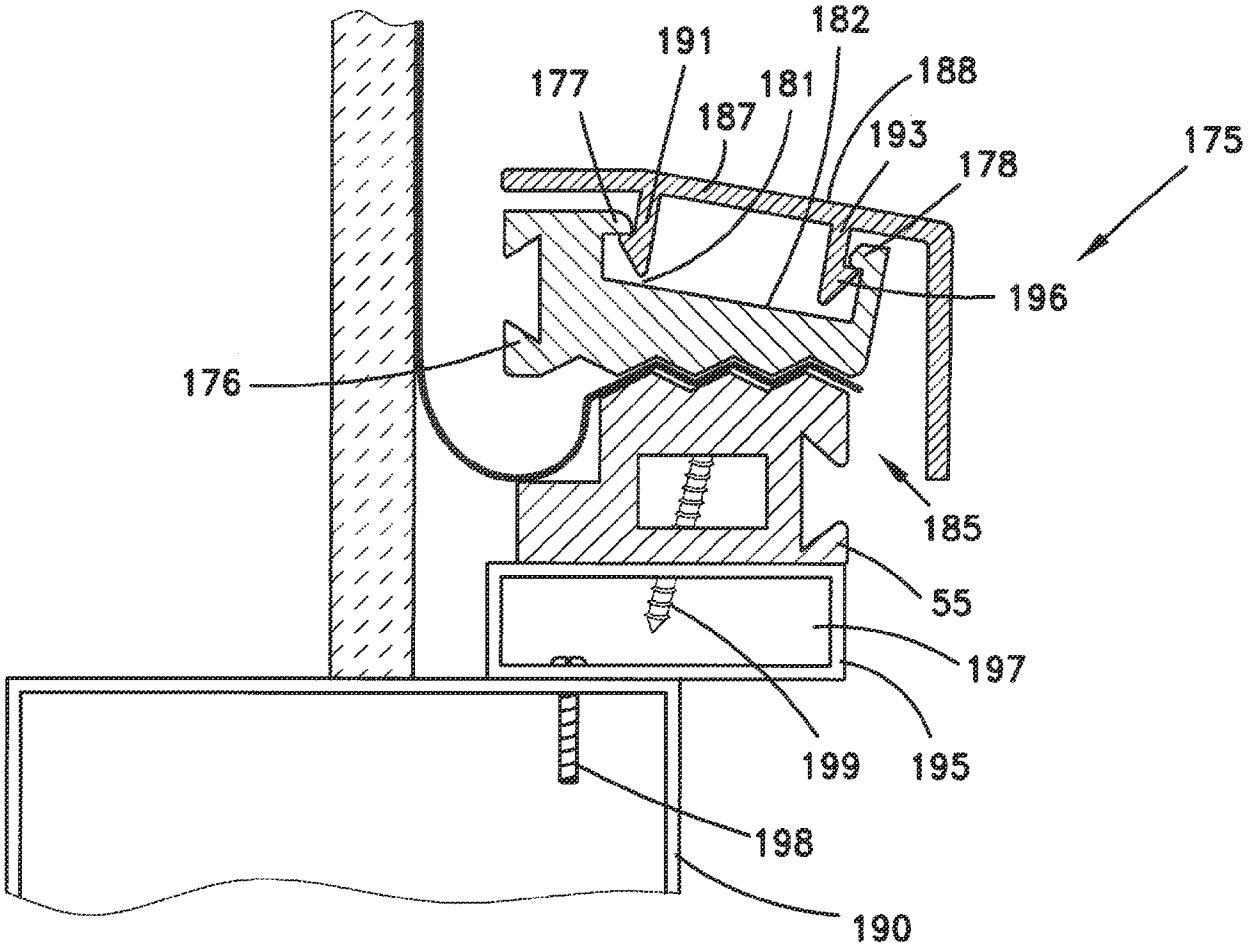
FIG. 11 is a vertical cross-sectional view of a curtain wall frame to a portion of which an anchoring device is attached by means of an adapter.

FIG. 11 illustrates curtain wall frame 175, to which anchoring device 185 is attached. In this embodiment, anchoring device 185 is provided with rectilinear adapter 195, which is needed when lower engagement member 55 cannot be attached to a frame portion 190 of curtain wall frame 175, due to the relatively small width of its corresponding abutment surface adapted to support the anchoring device. Adapter 195 as shown is hollow, and screws 198, or any other suitable metal fasteners inserted, within recess 197 of the adapter, are used to attach adapter 195 to frame portion 190. Lower engagement member 55 in turn is attached to adapter 195 by means of screws 199, or any other suitable metal fasteners.

It will be appreciated that an adapter may be employed in conjunction with any suitable window frame having a frame portion, to which an engagement member is attached, of a width less than said engagement member.

Anchoring device 185 also comprises upper engagement member 176 formed with a single recess 181, which is recessed with respect to protrusions 177 and 178 defining the upper oblique surface of coplanar portions of the upper surface of upper engagement member 176. Legs 191 and 193 protruding from the underside of cover 187 and terminating with a relatively wide portion 196 are adapted to couple with protrusions 177 and 178, respectively. Surface 182 delimiting recess 181 is substantially parallel to oblique portion 188 of cover 187, and screws 199 are adapted to pierce through surface 182.

EXAMPLE 1

The strength of a window pane provided with a window film and anchoring device of the present invention was tested when subjected to an air pressure differential between the inner and outer surfaces thereof.

The testing was conducted by Architectural Testing, Inc. at its test facility in Southlake, Tex., U.S.A. A monolithic glass having a thickness of ¼", an overall width of 36¼", an overall height of 62", and a glass opening size of 32½"×58½" was drop glazed with a wedge gasket on the interior and exterior of the glass. The window was of an aluminum fixed commercial type. The frame finish was anodized and the frame corners were attached with two ¼"×1" hex head bolts. The window units were installed with two ¼"×4" lag bolts located 11" from each other at the head and sill, and in the jambs at 6" from each end and 16" on center thereafter.

Three window units were tested in accordance with the ASTM E 330-97el standard entitled "Test Method for Structural Performance of Exterior Windows, Curtain Walls and Doors by Uniform Static Air Pressure Difference," by which a structural load normal to the glass and representative of an air pressure differential between the inner and outer surfaces of the glass is stabilized and maintained for 10 seconds. A structural load was recorded for each window unit that did not cause any glass breakage, permanent damage to bolts or frame, and any other damage which would result in the window unit to be inoperable.

The first unit was provided without any window film. The second unit had a pane to which was applied 12-mil clear SAFETYZONE™ film, manufactured by Hanita Coatings RCA Ltd., Israel, onto the inner side of the glass. The film was trimmed so that it did not contact the wedge gasket. The third unit had a pane to which was applied 12-mil clear SAFETYZONE™ film, manufactured by Hanita Coatings RCA Ltd., Israel, onto the inner side of the glass. Each free film portion was inserted between the engagement members of a corresponding anchoring device as shown in FIG. 9 of the present invention. Each anchoring device was secured to a jamb by #12.times.1¼" screws located 3" from each end and on 6" centers thereafter.

For the first window unit, a structural load of 150 psf was recorded. For the second window unit, a structural load of 245 psf was recorded. For the third window unit, a structural load of 420 psf was recorded, an increase of 71.4% with respect to that of the second window unit.

EXAMPLE 2

The blast resistance of a window pane provided with a window film and anchoring device of the present invention was tested.

Each pane made of annealed glass and having a thickness of 6 mm was surrounded by a commercially available aluminum frame, which was enclosed in a concrete reaction structure. A 12-mil clear SAFETYZONE™ film, manufactured by Hanita Coatings RCA Ltd., Israel, was applied onto the inner surface of the pane. Two sides of the window film were anchored such that each free film portion was inserted between the engagement members of a corresponding anchoring device as shown in FIG. 9 of the present invention.

The testing was conducted by the Israeli Defense Force (IDF) and the Israeli Foreign Ministry (IFM). Impulse sensors were affixed to the reaction structure. Pressure sensors were affixed to the inner surface of the pane, in order to detect the initial impact. Various window panes were exposed to test charges of TNT. As the blast wave propagated, a pressure was applied to each pane during a specific duration.

Figure 12:
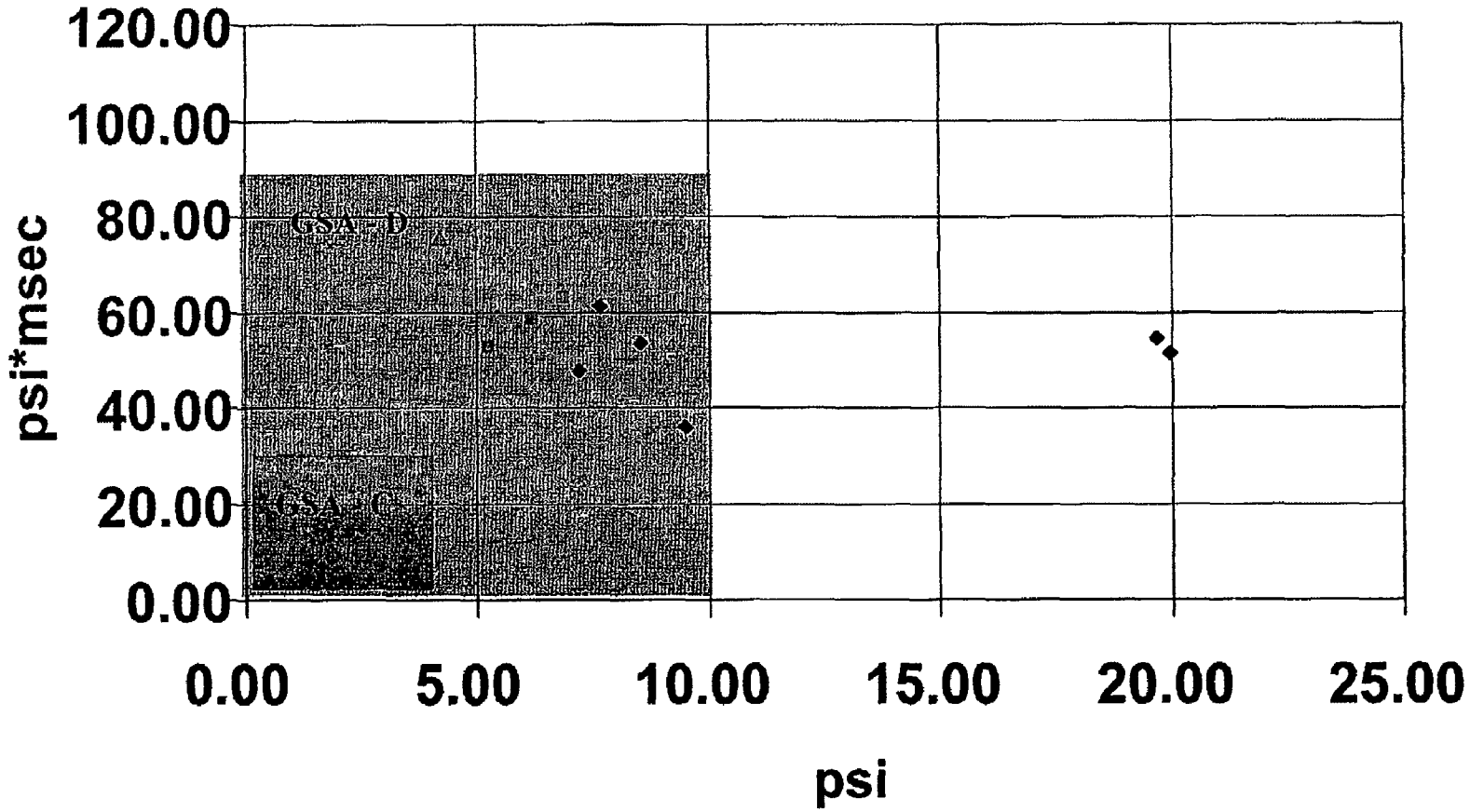
FIG. 12 is a scatter chart that compares impulse values at a given impact pressure resulting from a blast wave directed to a window pane to two opposite sides of which is applied an anchoring device of the present invention, with respect to GSA security criteria.

FIG. 12 illustrates the impulse or amount of energy that was imparted to the pane during the propagation of various blast waves. Each point on the graph represents the impulse of a blast wave at a given measured pressure. Each pane was therefore shown to comply with the GSA Level C security criteria, which specifies that for an impulse of 28 psi-msec at 4 psi, fragments of cracked glazing impact a vertical witness panel at a distance of no more than 10 ft from the window pane at a height no greater than 2 ft above the floor. Many of the panes were also shown to comply with the GSA Level D security criteria, which specifies that for an impulse of 89 psi-msec at 10 psi, fragments of cracked glazing land on the floor at a distance of no more than 10 ft from the window pane.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. Method of increasing the impact or impulse resistance of a window pane, comprising, a) providing an anchoring device comprising first and second engagement members;

b) directly attaching said second engagement member to a selected window frame portion;

c) adhering a window film to a window pane inner surface having a first visible portion dimension and a second visible portion dimension such that a free film portion not adhering to said pane extends from the visible pane portion;

d) positioning said free film portion to be in close proximity to said second engagement member; and e) interlocking said first engagement member with said second engagement member such that said free film portion is being constantly pressed by said first and second engagement members and said free film portion terminates in a distal direction of the first engagement member in respect to the window pane;

f) attaching said first engagement member to the selected frame portion, whereby film engaging surfaces of said first engagement member are in lateral motion preventing relation with complementary film engaging surfaces of said second engagement member.

2. The method according to claim 1, further comprising the steps of:

a) directly attaching the second engagement member which has a selected length substantially equal to said first visible portion dimension or said second visible portion dimension to a corresponding first frame portion;

b) attaching the window film which has a first dimension substantially equal to said selected length of said second engagement member and a second dimension significantly longer than said first visible portion dimension or said second visible portion dimension not being equal to said selected length of said second engagement member to said window pane visible portion such that at least one free film portion extends from said window pane visible portion;

c) applying a terminal portion of a first free film portion having said first window film dimension to film engaging surfaces of said second engagement member such that a portion of said free film portion can contact said first frame portion or said second engagement member;

e) placing a first engagement member having said selected length in pressing contact with said first free film portion such that film engaging surfaces of said first engagement member are in interlocking relation with corresponding film engaging surfaces of said second engagement member; and f) attaching said first engagement member to said first frame portion.

3. The method according to claim 2, wherein an anchoring device cover is releasably coupled with said first engagement member.

4. The method according to claim 3, wherein the anchoring device cover is releasably coupled with said first engagement member by a snap fit.

5. The method according to claim 2, wherein a second anchoring device is attached to a second frame portion opposite said first frame portion.

6. The method according to claim 5, wherein a third anchoring device is attached to a third frame portion perpendicular to said first frame portion.

7. The method according to claim 6, wherein a fourth anchoring device is attached to a fourth frame portion opposite said third frame portion.

8. The method according to claim 5, wherein a terminal portion of a second free film portion having said first window film dimension is applied to film engaging surfaces of a second engagement member of said second anchoring device.

9. The method according to claim 8, further comprising the steps of:

a) placing the first engagement member of said second anchoring device in pressing contact with said second free film portion which is applied to said second engagement member of said second anchoring device;

b) attaching said first engagement member of said second anchoring device to said second frame portion; and c) releasably coupling an anchoring device cover with said first engagement member of said second anchoring device.

10. The method according to claim 1, wherein the anchoring device is used to retrofit an existing window frame.

11. The method according to claim 10, wherein a gasket retainer and the gasket retained thereby are removed from the existing window frame and replaced by a gasket which is coupled with one of the first and second engagement members.

12. The method according to claim 1, wherein the inner surface of the window pane is cleaned before the first and second engagement members are attached to the frame portion.

13. The method according to claim 1, wherein the selected frame portion is an adapter for increasing the size of a frame abutment surface supporting the second engagement member.

14. A window frame assembly for increasing the impact or impulse resistance of a pane, comprising:

a) a vertically disposed window pane;

b) a frame associated with said pane;

c) an anchoring device comprising an upper engagement member and a lower engagement member attached to a portion of said frame; and d) a polymeric window film having a first portion affixed to said pane, a third portion received between said upper engagement member and said lower engagement member which are maintained in an interlocking and lateral motion preventing relation, and a second portion forming an unrestrained loop in a relaxed state extending between said first and third portions, whereby said lower engagement member directly contacts said frame and the polymeric window film terminates in a distal direction of the lower engagement member in respect to the window pane;

wherein said loop is stretchable when said pane is impacted, whereby to absorb impact energy applied to said pane.

15. The window frame assembly according to claim 14, wherein the interface between the upper and lower members comprises a plurality of alternating protruding and recessed film engaging surfaces, wherein the film engaging surfaces of said upper engagement member are in interlocking and lateral motion preventing relation with complementary film engaging surfaces of the lower engagement member.

16. The window frame assembly according to claim 15, wherein each pair of adjacent film engaging surfaces are in contact to define a pointed apex.

17. The window frame assembly according to claim 16, wherein corresponding apexes of the interlocked upper and lower engagement members are substantially collinear.

18. The window frame assembly according to claim 15, wherein the film engaging surfaces of the upper and lower engagement members are curvilinear.

19. The window frame assembly according to claim 15, wherein a plurality of protruding film engaging surfaces of the upper member are received in corresponding recessed film engaging surfaces of the lower member and a plurality of protruding film engaging surfaces of the lower member are received in corresponding recessed film engaging surfaces of the upper member.

20. The window frame assembly according to claim 14, further comprising a cover which is coupleable with the upper engagement member.

21. The window frame assembly according to claim 20, wherein the cover has a horizontal portion and a portion oblique to said horizontal portion.

22. The window frame assembly according to claim 21, wherein the anchoring device is attached to a first window frame portion and a cover side wall is coplanar with, and is in contact with, a corresponding side wall of said first frame portion.

23. The window frame assembly according to claim 22, further comprising a second anchoring device which is attached to a second frame portion opposite to the first frame portion, said second anchoring device having a cover side wall which is coplanar with, and is in contact with, a corresponding side wall of said second frame portion.

24. The window frame assembly according to claim 23, wherein a third anchoring device is attached to a third frame portion substantially perpendicular to the first frame portion.

25. The window frame assembly according to claim 24, wherein a fourth anchoring device is attached to a fourth frame portion opposite to a third frame bottom member.

26. The window frame assembly according to claim 23, which has an impact resistance of up to 20 psi.

27. The window frame assembly according to claim 23, which has an impulse resistance of up to 100 psi-msec.

28. The window frame assembly according to claim 14, wherein the lower engagement member has first and second sidewalls which are substantially parallel to the pane, inwardly spaced from the pane, and outwardly and downwardly spaced from the interface, said second sidewall being disposed below said first sidewall to increase the length of the unrestrained loop.

29. The window frame assembly according to claim 14, wherein the lower engagement member directly contacts an adapter of the frame for increasing the size of a frame abutment surface supporting the anchoring device.

* * * * *